US010865530B2

(12) United States Patent
Wilkens et al.

(10) Patent No.: US 10,865,530 B2
(45) Date of Patent: Dec. 15, 2020

(54) TAPE MACHINE

(71) Applicants: Jeffrey Arnold Wilkens, West Fargo, ND (US); Timothy John Marthe, Relies Acres, ND (US); Reise Jordon Stenberg, Argusville, ND (US)

(72) Inventors: Jeffrey Arnold Wilkens, West Fargo, ND (US); Timothy John Marthe, Relies Acres, ND (US); Reise Jordon Stenberg, Argusville, ND (US)

(73) Assignee: Epic Solutions, Inc.

( * ) Notice: Subject to any disclaimer, the term of this patent is extended or adjusted under 35 U.S.C. 154(b) by 0 days.

(21) Appl. No.: 16/667,445

(22) Filed: Oct. 29, 2019

(65) Prior Publication Data

US 2020/0157750 A1 May 21, 2020

Related U.S. Application Data

(63) Continuation-in-part of application No. 16/510,879, filed on Jul. 13, 2019, now abandoned, which is a continuation of application No. 16/184,765, filed on Nov. 8, 2018, now abandoned, which is a continuation-in-part of application No. 15/926,785, filed on Mar. 20, 2018, now abandoned.

(60) Provisional application No. 62/473,645, filed on Mar. 20, 2017.

(51) Int. Cl.

| | |
|---|---|
| ***E01C 23/00*** | (2006.01) |
| ***E01C 23/18*** | (2006.01) |
| ***B65H 35/00*** | (2006.01) |

(52) U.S. Cl.

CPC ..... *E01C 23/185* (2013.01); *B65H 35/0013* (2013.01); *B65H 35/0066* (2013.01); *B65H 35/0086* (2013.01); *B65H 2701/1922* (2013.01)

(58) Field of Classification Search

CPC ..... E01C 23/185; B65H 35/0013; B65H 35/0066; B65H 2701/1922

USPC ..... 404/94

See application file for complete search history.

(56) References Cited

U.S. PATENT DOCUMENTS

| | | | | |
|---|---|---|---|---|
| 2,192,290 A * | 3/1940 | O'Neal | E01F 9/578 156/390 |
| 2,546,308 A | 3/1951 | Kahler | |
| 3,717,540 A | 2/1973 | Henc | |
| 3,844,669 A * | 10/1974 | Eigenmann | E01C 23/14 404/94 |
| 3,886,011 A | 5/1975 | Eigenmann | |
| 3,964,559 A | 6/1976 | Eigenmann | |
| 3,964,835 A | 6/1976 | Eigenmann | |
| 4,030,958 A | 6/1977 | Stenemann | |

(Continued)

FOREIGN PATENT DOCUMENTS

EP 2366833 B1 3/2016

*Primary Examiner* — Raymond W Addie

(74) *Attorney, Agent, or Firm* — Snell & Wilmer L.L.P.; Russell T. Manning

(57) ABSTRACT

An automated tape applicator that applies pavement marking tape to a pavement surface. The automated tape applicator may include dual knives for cutting two or more patterns simultaneously, a hinged frame that permits an adhesion roller to be lifted off the ground when not in active use, an electronic clutch for selectively engaging a tape feed mechanism, a swiveling front tire, an automated controller for simultaneous application of multiple markings and accurate dimensioning, and/or replaceable knife inserts.

11 Claims, 7 Drawing Sheets

(56) References Cited

U.S. PATENT DOCUMENTS

| | | | | | |
|---|---|---|---|---|---|
| 4,082,587 | A | * | 4/1978 | Eigenmann | E01C 23/185 118/202 |
| 4,102,718 | A | * | 7/1978 | Eigenmann | E01C 23/185 156/291 |
| 4,236,950 | A | * | 12/1980 | Eigenmann | E01C 23/185 118/305 |
| 4,242,173 | A | | 12/1980 | Stenemann | |
| 4,313,780 | A | | 2/1982 | Ford, Jr. | |
| 4,317,696 | A | | 3/1982 | Hutchinson et al. | |
| 4,623,280 | A | * | 11/1986 | Stenemann | E01C 23/18 156/541 |
| 4,824,516 | A | | 4/1989 | Ishihara et al. | |
| 4,974,990 | A | * | 12/1990 | Anderson | E01C 23/18 221/185 |
| 5,772,359 | A | | 6/1998 | Marty | |
| 5,785,453 | A | * | 7/1998 | Marty | E01C 23/185 280/32.7 |
| 5,800,668 | A | | 9/1998 | Bumb | |
| 5,865,943 | A | | 2/1999 | Marty | |
| 6,413,013 | B1 | | 7/2002 | Requena | |
| 9,284,699 | B1 | | 3/2016 | Arnold | |
| 10,112,794 | B1 | * | 10/2018 | Shea | E01C 23/06 |
| 2004/0129387 | A1 | | 7/2004 | Ibrahim et al. | |
| 2011/0229265 | A1 | | 9/2011 | Schottka | |
| 2013/0022397 | A1 | | 1/2013 | Ringus et al. | |
| 2014/0064849 | A1 | * | 3/2014 | Arnold | E01C 23/185 404/75 |
| 2014/0377001 | A1 | | 12/2014 | Gassman | |
| 2015/0377615 | A1 | | 12/2015 | Lake | |

* cited by examiner

TAPE MACHINE

CROSS-REFERENCE TO RELATED APPLICATIONS

This application is a continuation-in-part of U.S. patent application Ser. No. 16/510,879, having a filing date of Jul. 13, 2019, entitled "TAPE MACHINE," which is a continuation of U.S. patent application Ser. No. 16/184,765 having a filing date of Nov. 11, 2018, entitled "TAPE MACHINE," which is a continuation-in-part of U.S. patent application Ser. No. 15/926,785 having a filing date of Mar. 20, 2018, entitled "TAPE MACHINE," which claims the benefit of U.S. Prov. App. No. 62,473,645 having a filing date of Mar. 20, 2017, all of which are incorporated herein in their entirety by reference.

FIELD

The present disclosure relates to pavement marking. More particularly, the disclosure relates to an improved tape applicator that applies pavement marking tape to a pavement surface.

BACKGROUND

It is well known that roadways, crosswalks, parking lots, airports and other types of pavement surfaces have pavement markings (e.g., lines, intermittent stripes, labels, words, etc.) painted on them to guide vehicle traffic, pedestrians, etc. Pavement marking materials (e.g., paints, tapes, thermoplastics, etc.) are frequently used to create visible stripes or lines. Due to the extended lengths of certain pavement markings such a highway centerline, applying paint is typically the most cost-effective way to mark pavement surfaces. However, in some applications, it is desirable to apply a premade pavement marking tape to a pavement surface. Though typically more expensive, such pavement marking tapes may be desirable in locations of heavy use and/or where improved reflective qualities are desired.

Often times, rather than manual application by hand, pavement marking tape is applied using a tape applicator. Various forms of tape applicators are known, but prior solutions are associated with several shortcomings. For example, many pavement markings consist of more than one line or stripe (e.g., highway centerline with passing zone in one direction has a solid and a skip line). Such pavement markings require at least two passes with a tape applicator, one pass to install a solid line and another pass to install a skip line.

Further, known tape applicators may utilize a roller which rests against the pavement surface and applies pressure to the top side (i.e., non-adhesive) of the tape to press the adhesive side of the tape against the ground. Such rollers are large and cumbersome making tape applicators difficult and time-consuming to maneuver.

Further still, tape applicators are known to deviate from desired length and spacing specifications. In this regard, various components of the machines may shift out of synchronization causing spacing issues between stripes. Further in this regard, certain moving components of known machines remain in motion even when tape is not actively being laid onto the pavement surface. This may cause the moving parts to rub against the loaded tape which is stationary causing damage to the reflective surface and possibly breakage.

Lastly, existing tape applicators utilize control systems which fail to account for variations in environmental and operating conditions. For example, some machines are controlled by a timing system which accepts a theoretical speed and assumes no variation in actual speed. In this regard, a machine may be programmed to operate at 2 km/h and the timing of cuts to the tape may be based off this hypothetical speed. In reality, bumps, cracks, or other imperfections in the pavement surface may cause the machine to operate slightly slower or faster at various times, thereby causing inaccuracy in the placement of markings.

SUMMARY

Provided herein is an automated tape applicator for pavement marking tape offering several advantages over prior solutions. The automated tape applicator has a number of features that overcome the deficiencies described above in the background section including, inter alia, dual knives for cutting two or more patterns simultaneously; replaceable knife inserts; a hinged frame that permits the adhesion roller to be lifted off the ground when not in use; a swiveling front tire; a clutch for selectively engaging a tape feed mechanism; and/or an automated controller for simultaneous application of multiple markings and accurate dimensioning. Each of these features may be novel in the context of a pavement marking tape applicator independently as well as in various combinations.

A cutting assembly featuring dual knives enables the automated tape applicator described herein to install two or more lines simultaneously. Each of the two or more lines may utilize the same or different patterns. For example, a solid line may be installed at the same time as a skip line. In this regard, the automated tape applicator may install a complex pavement marking (e.g., one utilizing multiple patterns) in a single pass. Notably, although described herein as a dual knife system, it should be appreciated that any number of knives may be utilized with the principles described herein.

Each knife (or blade) may be operated independently by an actuator. In a preferred embodiment, compressed air may be used to power a pneumatic system driving the knife actuators. The compressed air may be supplied by an on-board storage tank or gas-powered compressor. Alternative mechanisms for powering the actuators are envisaged including electrical actuators, hydraulics, etc. The automated controller of the automated tape applicator may directly control operation of the knife actuators (e.g., electric actuators) or may control valves that, in turn, control the knife actuators (e.g., pneumatic actuators). The automated controller may operate each of the dual knives independently based upon a selectable pattern used for each roll of pavement marking tape.

Rather than using single-piece knives as is known in the art, replaceable knife inserts may be used. In this regard, when a blade edge is worn and needs replacement, there is no need to replace the entire knife body but rather only the knife insert may be replaced. Such a design may reduce time and costs associated with replacement. The knife body which holds a knife insert may be constructed from a first material and the knife insert may be constructed from a second material.

A hinged frame may be used to enable an operator to lift and lock the adhesion roller off the ground when not in use. The vertical hinge may be an integral part of the frame of the automated tape applicator or may formed within or in conjunction with a carrier vehicle. In the exemplary embodiment illustrated in the figures and described below, the carrier vehicle is a cart designed to be maneuvered by an operator. With this design, an operator may manually lift the machine's frame (and mechanisms attached thereto such as the adhesion roller) and lock it into an elevated position (e.g., with a linchpin or other locking mechanism), or an assistance mechanism may be provided to aid in lifting the frame such as a linear actuator, a cable and winch, etc. By raising the frame into the elevated position, the adhesion roller may be lifted from the ground. This may facilitate improved maneuverability of the machine and may also reduce wear and tear on the adhesion roller and mechanically associated components.

Alternatively, a carrier vehicle may be a pickup truck, a towable trailer, or a specialty truck outfitted with one or more automated tape applicators mounted to a chassis. In this regard, the frame may be hingedly mounted to the carrier vehicle or may be retractable to raise and lower the machine as desired.

Particularly in the exemplary embodiment which utilizes a cart as a carrier vehicle, a swiveling front tire may be disposed upon the cart, or directly affixed to the automated tape applicator, to improve maneuverability. Given the substantial weight of the automated tape applicator and associated components, it may be quite difficult for an operator to manipulate the machine into a desired position and orientation, especially when the adhesion roller is resting on the ground with the weight of the machine thereupon (as is the case with many prior machines). A swiveling wheel may simplify the task of positioning and orienting the automated tape applicator immediately prior to, or during, application of a pavement marking.

A locking mechanism may also be provided to lock the swiveling wheel into a fixed position. This may be desirable, for example, for application of a long straight line. In this regard, swiveling of the wheel may be desirable for unloading the automated tape applicator from a trailer or truck, moving the machine within a jobsite, and initially aligning the machine into a starting position. However, the swiveling may cause difficulty during application when it may be imperative to maintain a substantially straight line. By providing a locking mechanism, an operator may selectively toggle the wheel (or wheels) between a swiveling and locked configuration. This may be accomplished manually by manipulating the locking mechanism by hand while the carrier vehicle is stopper, by manipulating a remote lock controller (e.g., wireless radio transmitter with a receiver disposed at the locking mechanism, or a mechanical cable with a lever disposed near the handlebar), or the automated controller may operate the locking mechanism.

A clutch (e.g., electronic, pneumatic, etc.) may be incorporated into an automated tape applicator in accordance with the present disclosure to engage or disengage an upper guide roller. In this regard, in an exemplary embodiment, the adhesion roller may be mechanically synchronized to the upper guide roller by a chain or belt drive. This may be desirable to ensure both rollers operate at the same speed to consistently feed pavement marking tape to the pavement surface. However, when pavement marking tape is not actively being applied, it may be desirable to disengage the upper roller to prevent unnecessary wear and stress to the pavement marking tape and to cease the feeding of pavement marking tape to the adhesion roller. Therefore, a clutch may be disposed between the upper guide roller and the drive mechanism to allow the adhesion roller to roll as the machine traverses the ground while stopping the rotation of the upper guide roller. Moreover, sensors (e.g., optical, tension, etc.) may be deployed to monitor a level of slack occurring in the pavement marking tape between the upper guide roller and the adhesion roller, as an increase in slack may occur if the upper guide roller is operating too quickly in relation to the adhesion roller (or if slippage occurs somewhere in the system). The sensor(s) may send an observation signal to the automated controller and, in turn, the automated controller may send a control signal to the clutch to temporarily slow the upper guide roller and remove the excess slack. The clutch may be controlled via an automated controller.

Furthermore, an automated controller may be provided which synchronizes operation of a plurality of actuators and the clutch to apply pavement marking tape in a desired pattern(s). The automated controller may allow an operator to select from a plurality of preprogrammed patterns and settings, for example a solid/skip highway centerline and 6 in. wide, 12 mil. tape, or an operator may be able to manually enter customized patterns and settings. Using the selected parameters (e.g., a pattern and size settings for each roll) the automated controller may selectively actuate the clutch, the knife actuators, upper and lower feed mechanism actuators (to press the pavement marking tape against the upper guide roller and/or adhesion roller), etc.

Notably, the automated controller may be operable to apply two or more patterns simultaneously. In this regard, certain components may be operated independently to effectuate the application of pavement markings using separate rolls of pavement marking tape at different times. For example, a solid line may be applied from a first roll of pavement marking tape when the automated controller engages the clutch and extends the upper feed mechanism. In this regard, the upper feed mechanism may be pressed against the upper guide roller to feed pavement marking tape from the first roll to the adhesion roller. By omitting actuation of the respective knife actuator, a solid line is applied. It should be appreciated that once the pavement marking tape is fed to the adhesion roller, the upper feed mechanism may be retracted and/or the clutch may be disengaged as these mechanisms may only be needed to initiate the feeding of pavement marking tape to the adhesion roller.

Simultaneously, a skip line may be applied when the automated controller implements a cycle of: cutting pavement marking tape from a second roll by actuating the knife actuator associated with the second roll, retracting the upper feed mechanism, disengaging the clutch to stop the upper guide roller to prevent feeding from the second roll, measuring a distance traversed, re-engaging the clutch and actuating the upper feed mechanism actuator to feed from the second roll, and measuring a distance traversed before actuating the second roll knife actuator again, all based upon the parameters selected with the automated controller.

It should be appreciated that in the above example, the solid line may continue to be applied even after the clutch is disengaged as the adhesion roller will continue pulling on the first roll of pavement marking tape. With the upper feed mechanism retracted and the clutch disengaged, the second roll of pavement marking tape may remain stationary while the first roll of pavement marking tape continues to feed.

Measuring of distance traversed to appropriately time the actuation of the various components may be accomplished with any number of sensors. For example, with a known circumference of the adhesion roller, rotations of the adhesion roller may be monitored with an optical sensor to calculate a distance traversed. Alternatively or additionally, an inductive proximity sensor may be used to transmit a pulse each time a tooth on a chain sprocket of the drive mechanism passes by the sensor. In this regard, the actuation of the various components may correspond to an actual distance traveled rather than timing actuating based on a theoretical or expected speed.

The details of one or more embodiments of the devices, systems and processes are set forth in the accompanying drawings and the description below. Other features, objects, and advantages of the invention will be apparent from the description, drawings, and claims.

BRIEF DESCRIPTION OF THE DRAWINGS

For a more complete understanding of the present disclosure and further advantages thereof, reference is now made to the following detailed description taken in conjunction with the drawings in which.

Figure 1A:
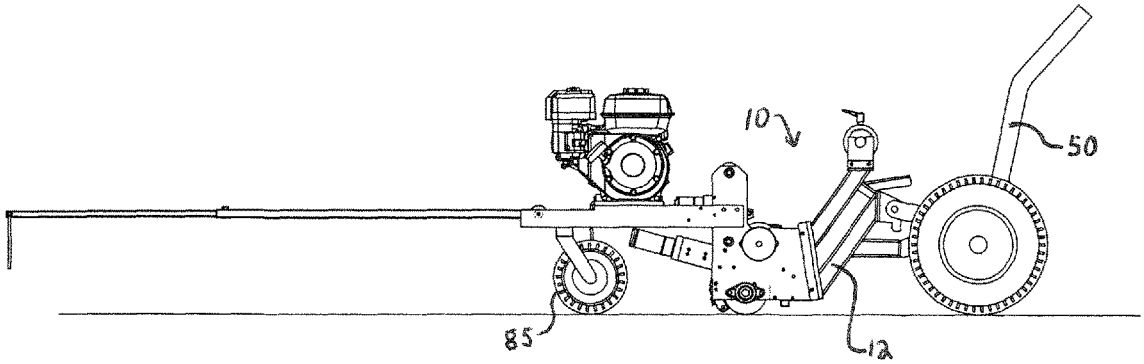
FIG. 1A illustrates a left side view of an automated tape applicator mounted to a cart according to the present disclosure.

While the invention is susceptible to various modifications and alternative forms, specifics have been shown by way of example in the drawings and will be described in detail below. It should be understood that the intention of the detailed description is not to limit aspects of the invention to the particular embodiments described. Rather, the invention covers all modifications, equivalents, and alternatives falling within the spirit and scope of the invention.

DETAILED DESCRIPTION

Reference will now be made to the accompanying drawings, which at least assist in illustrating the various pertinent features of the presented inventions. The following description is presented for purposes of illustration and description. Furthermore, the description is not intended to limit the disclosed embodiments of the inventions to the forms disclosed herein. Consequently, variations and modifications commensurate with the following teachings, and skill and knowledge of the relevant art, are within the scope of the presented inventions.

Figure 1B:
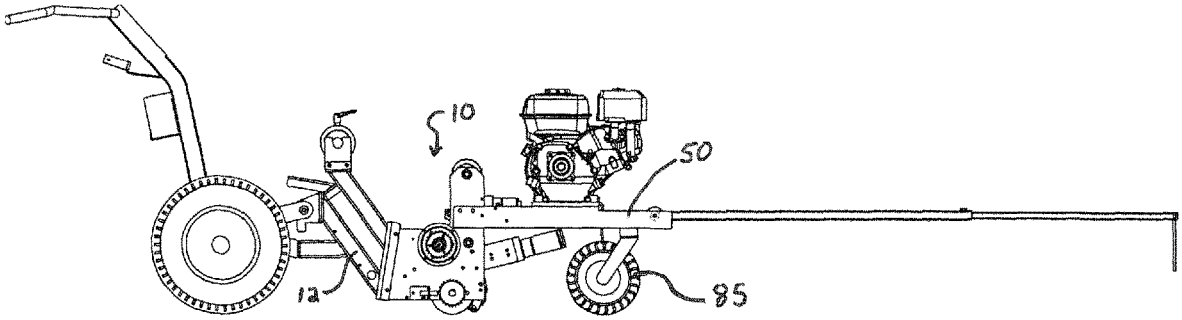
FIG. 1B illustrates a right side view of the automated tape applicator of FIG. 1A.

FIGS. 1A and 1B illustrate an embodiment of an automated tape applicator ("ATA") 10. The ATA 10 includes a frame 12, which may be attached to any number of different types of equipment including, but not limited to, carrier vehicles such as trucks, pickups, ATV vehicles, and walk behind carts. In the illustrated embodiment, the ATA 10 is illustrated as being mounted to a walk behind cart 50, which includes two or more rear wheels and at least one front or rear swiveling wheel 85. However, this embodiment is provided by way of example and not by way of limitation. As shown in the illustrated embodiment, the cart 50 has a swiveling wheel 85 installed at the front end which allows the ATA 10 to be positioned easier than other methods with less effort by the operator. A locking mechanism may be provided in conjunction with the swiveling wheel 85 to secure the wheel once the ATA 10 has been moved into the desired position and orientation to aid the operator in maintaining a straight line. Notably, a swiveling wheel 85 may be disposed on the rear end of cart 50 instead of the front end, and multiple swiveling wheels may also be utilized.

Figure 2A:
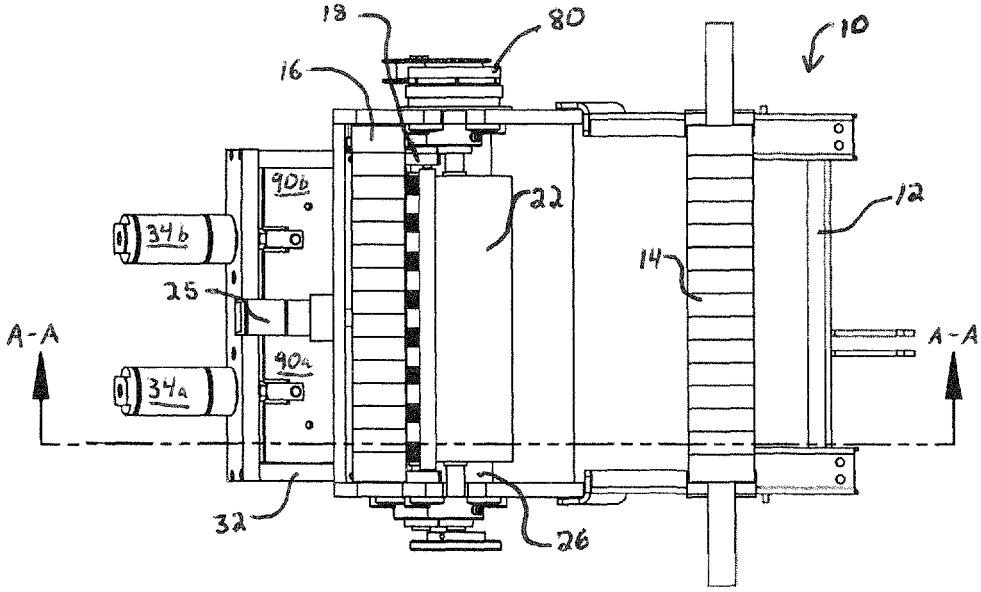
FIG. 2A illustrates a top view of an automated tape applicator without a carrier vehicle.
Figure 2B:
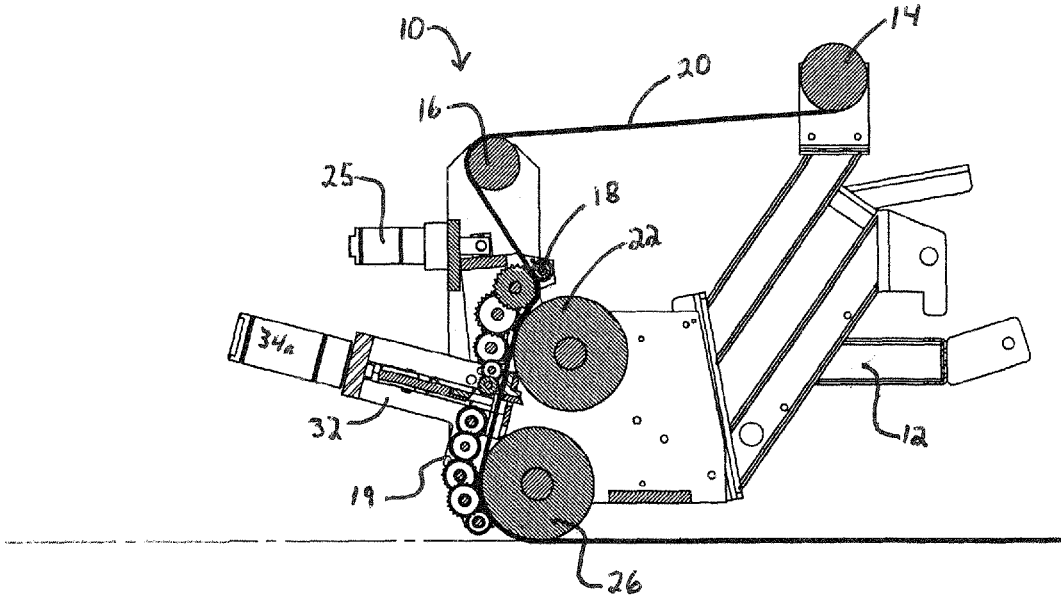
FIG. 2B illustrates a left sectional view (A-A) of the automated tape applicator of FIG. 2A.
Figure 2C:
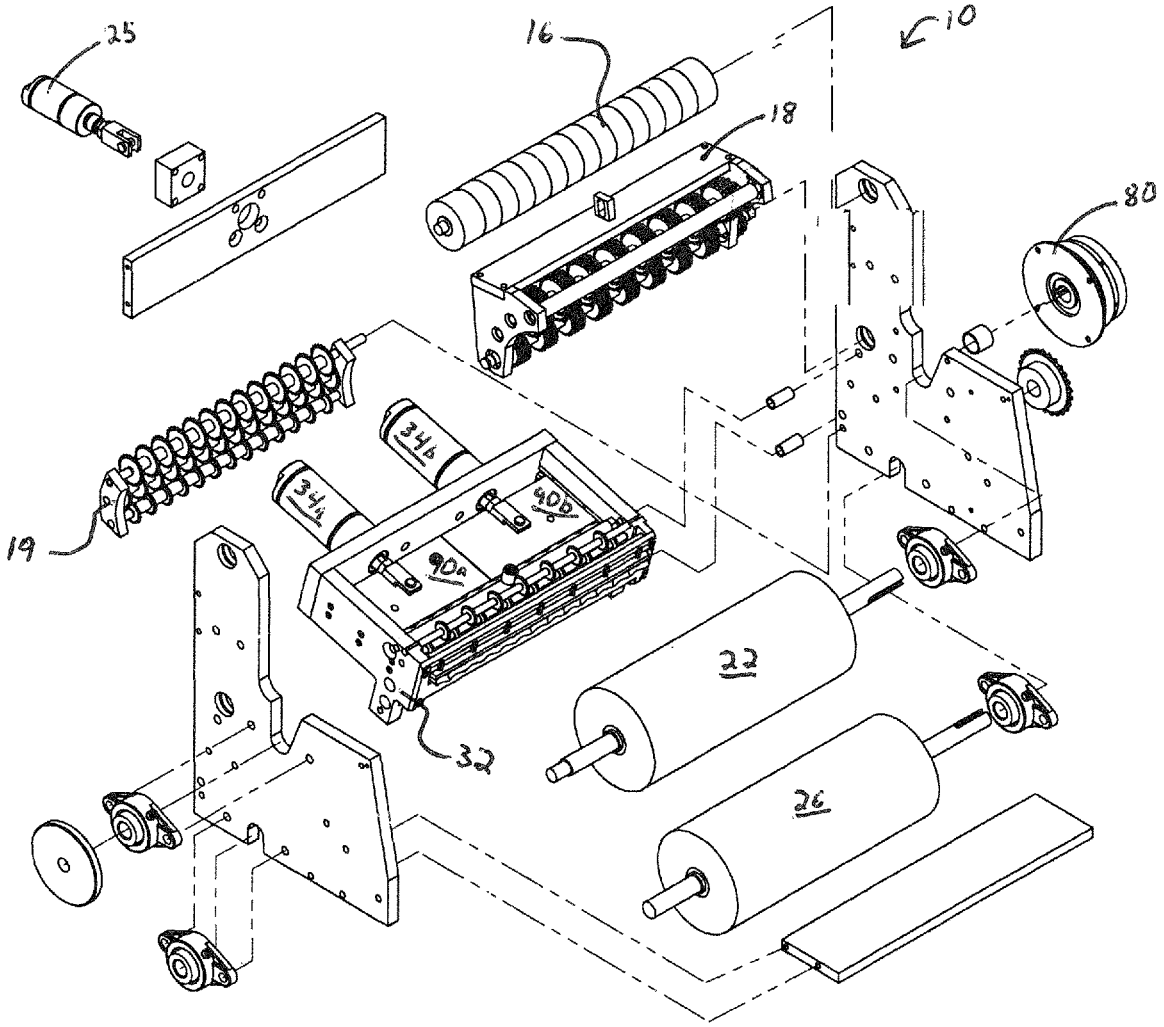
FIG. 2C illustrates an exploded view of the automated tape applicator of FIG. 2A.

As shown in FIGS. 2A-2C, the ATA 10 has a frame 12 that supports a number of rollers, spindles, actuators, etc. that allow for application of pavement marking tape 20 to a pavement surface. One or more rolls of pavement marking tape may be installed on supply spindle 14. The pavement marking tape 20 may be positioned at a desired location along the length of the supply spindle 14 and secured with spacing rings, which may be adjustable, to retain each roll of pavement marking tape in the desired alignment. The pavement marking tape from the supply spindle 14 may pass over a tensioning roller 16 which aids in maintaining a suitable level of tension on the pavement marking tape as it is being applied. After passing over the tensioning roller 16, the pavement marking tape may pass between an upper feed mechanism 18 and an upper guide roller 22. The upper feed mechanism 18 includes a number of rollers which engage the adhesive side of the pavement marking tape to press the pavement marking tape into the upper guide roller, thereby feeding tape from the roll(s) down toward an adhesion roller 26 and lower feed mechanism 19. The lower feed mechanism 19 may include, similar to the upper feed mechanism 18, a plurality of rollers for engaging the adhesive side of the pavement marking tape to sandwich the tape between the lower feed mechanism 19 and the adhesion roller 26. The rollers of the upper feed mechanism 18 and lower feed mechanism 19 may comprise ridges, sprockets, teeth, or the like to reduce to the surface area which contacts the adhesive side of the tape to prevent binding or sticking of the tape on the feed mechanism rollers. The rollers and/or ridges may be made from any suitable material such as metal or plastic.

The rotation of the adhesion roller 26 may be driven by engagement of the adhesion roller 26 with a pavement surface. In this regard, when the carrier vehicle stops, the adhesion roller 26 may also stop. A drive mechanism may connect the adhesion roller 26 and upper guide roller 22 such that rotation of the upper guide roller 22 is also driven by engagement of the adhesion roller 26 with the pavement surface. A clutch 80 may be included in the drive mechanism to engage and disengage the upper guide roller 22 when needed. For example, the automated controller of the ATA 10 may send a signal for the clutch 80 to engage the upper guide roller 22 when a free end of pavement marking tape 20 is suspended between the upper guide roller 22 and adhesion roller 26. This engagement may cause the free end of the tape to be fed downward to the adhesion roller 26. In contrast, when a cut is made, for example, to begin a gap in a skip line, the clutch 80 may disengage the upper guide roller 22 to prevent the feeding of tape to the adhesion roller 26.

One or more of the rollers of the upper feed mechanism 18 may be attached to a carriage which is positionable towards and away from the upper guide roller 22. In the illustrated embodiment, the bottom portion of the carriage is fixed to the frame 12 and the upper portion of the carriage is attached to an upper feed mechanism actuator 25. In this regard, by pivoting the carriage with the actuator 25, the upper feed mechanism 18 may be extended toward the upper guide roller 22 or retracted therefrom. Accordingly, when the upper guide roller 22 is rotated by a drive mechanism connecting the upper guide roller 22 to the adhesion roller 26 (as more fully discussed below), the pavement marking tape 20, which is pinched between the upper guide roller 22 and the upper feed mechanism 18, is fed between the lower feed mechanism 19 and the adhesion roller 26. After passing between the lower feed mechanism 19 and adhesion roller 26, the pavement marking tape 20 is compressed onto the pavement surface by weight from the ATA 10 resting on the adhesion roller 26.

The ATA 10 also includes cutting mechanism 32 which includes one or more knives 90A, 90B actuated by actuators 34*a*, 34*b*. Actuation of an actuator 34 results in advancement of the respective knife 90 to cut the pavement marking tape 20 to a desired length. As more fully discussed below, upon cutting the pavement marking tape 20, the rotation of the upper guide roller 22 and upper feed mechanism 18 may cease until an additional pavement marking tape strip is needed.

FIG. 2B shows a left sectional view of cross-section A-A of FIG. 2A of an ATA 10 in the application configuration (i.e., frame 12 is pivoted downward such that adhesion roller 26 rests on the ground). In this view, it can be seen that the pavement marking tape 20 is fed from a roll on supply spindle 14, over tensioning roller 16, between upper feed mechanism 18 and upper guide roller 22, between lower feed mechanism 19 and adhesion roller 26, and onto the pavement surface 30. Notably, in this illustrated stage, the pavement marking tape 20 is sandwiched between the pavement surface 30 and the adhesion roller 26 such that forward movement of the ATA 10 will result in tape being pulled from the roll(s) on supply spindle 14. In this regard, the actuator 25 may retract the upper feed mechanism 18 and the clutch 80 may disengage the upper guide roller 22 as these features may not be needed at this stage. When an operator desires to cease application of the pavement marking tape, or when the automated controller initiates a cut in accordance with a selected pattern, actuator 34 may extend knife 90 to cut the tape. With the clutch 80 disengaged from the upper guide roller 22, the portion of tape 20 above the knife 90 remains stationary while the portion of tape 20 below the knife 90 is applied to the pavement surface 30.

Figure 3:
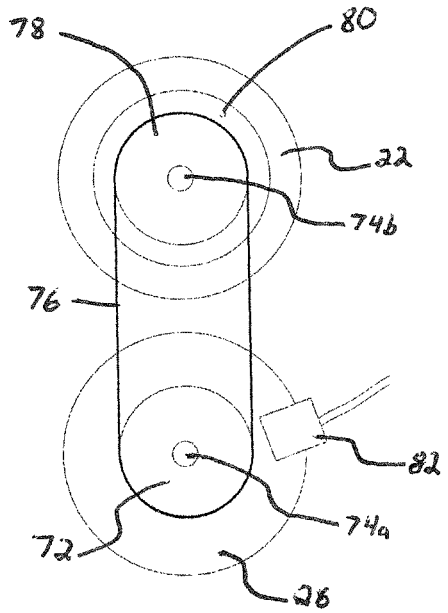
FIG. 3 illustrates a drive mechanism and associated proximity sensor.

FIG. 3 illustrates the drive mechanism connecting the upper guide roller 22 to the adhesion roller 26. As shown, the adhesion roller 26 has a lower sprocket 72 attached to its axle 74*a*. The lower sprocket 72 connects to an upper sprocket 78 which is attached to an axle 74*b* of the upper guide roller 22 via a chain 76. Accordingly, when the adhesion roller 26 is rolled across the pavement surface, rotation of the adhesion roller 26 is translated to the upper guide roller 22 via the chain 76 connecting the two sprockets 72, 78. This, in conjunction with extension of the upper feed mechanism 18 against the upper guide roller 22 permits feeding pavement marking tape 20 to the adhesion roller 26. However, the present inventors have determined that it is not desirable to continually drive the upper guide roller 22. That is, when the pavement marking tape 20 is cut to a desired length it may be desirable to cease feeding pavement marking tape 20 to the adhesion roller 26 by discontinuing rotation of the upper guide roller 22 and upper feed mechanism 18. Accordingly, the inventors have determined it is desirable to utilize a clutch 80 to disengage the upper guide roller 22. The clutch 80 may be interconnected between the upper sprocket 78 and the axle 74*b* of the upper guide roller 22. Accordingly, the automated controller is operative to disengage the clutch 80 once the pavement marking tape 20 being fed to the adhesion roller 26 is cut. That is, the clutch may be disengaged when there is no need to drive the upper guide roller 22.

As shown in FIG. 3, a sensor 82 may be used to measure the rotation of the adhesion roller 26. In one embodiment, the sensor 82 is a proximity sensor that gives a pulse each time a tooth on the respective sprocket (in the illustrated embodiment, the lower sprocket 72) moves past the sensor 82. This information is provided to the automated controller to determine distance traveled. Other sensor configurations are also envisaged such as an optical sensor which detects markings on the adhesion roller, or on a belt, for example, in the case that smooth pulleys are used in lieu of toothed sprockets. In any arrangement, such a sensor 82 allows for measuring distance which can be utilized to control the cutting mechanism 32 and/or engagement and disengagement of the clutch 80 to appropriately time the various components of the ATA 10 and lay pavement marking tape 20 in accordance with the selected pattern(s).

Figure 4:
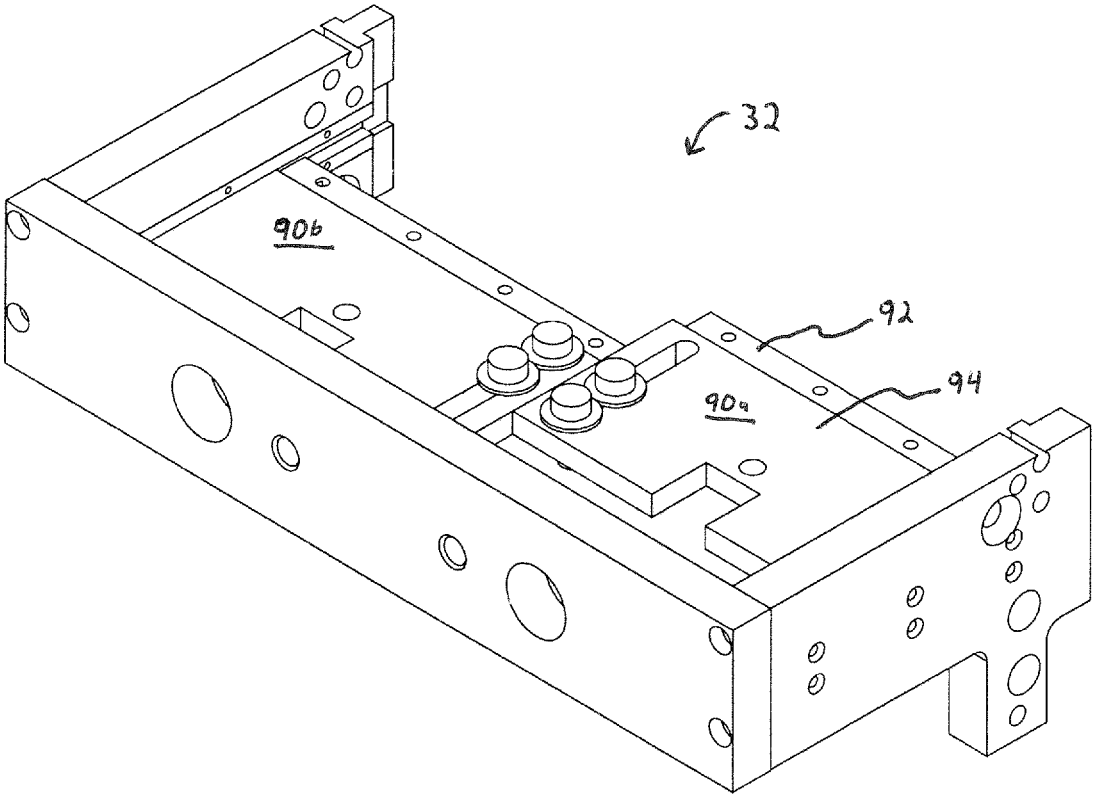
FIG. 4 illustrates a dual blade arrangement.

FIG. 4 illustrates the cutting mechanism 32. Notably, in this embodiment, a dual knife arrangement is used although it is contemplated that any appropriate number of knives could be used, for example, a single knife or three knives.

Each knife 90*a*, 90*b* comprises a replaceable knife insert design. A knife insert 92 may be attached to a knife body 94. As shown the knife insert 92 attaches to the knife body 94 with a set of mating apertures and associated screws or bolts (not shown). This allows replacing the knife insert 92 when it becomes worn rather than needing to sharpen or replace the much larger knife assembly. This is important as the cost of the knife insert 92 may be much less than an entire knife 90. The knife insert 92 may be constructed from a different material than the knife body 94. In this regard, the knife body 94 may be constructed from a sturdy and durable material to ensure a long service life while the knife insert 92, which will wear and dull regardless, may be constructed from a hardened material. Alternatively, the knife insert 92 may be constructed from a more durable material than the knife body 94 to extend the service life of the knife insert 92 while avoiding excessive costs associated with constructing the large knife body 94 from a more durable material. The knife insert 92 may be serrated to promote effective cutting.

Figure 5:
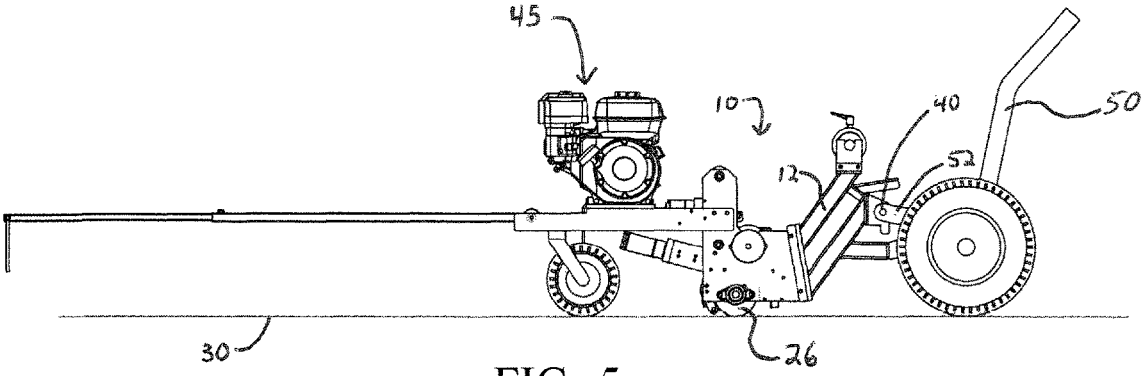
FIG. 5 illustrates an embodiment of a hinged attachment of an automated tape applicator to a cart in an application configuration.
Figure 6:
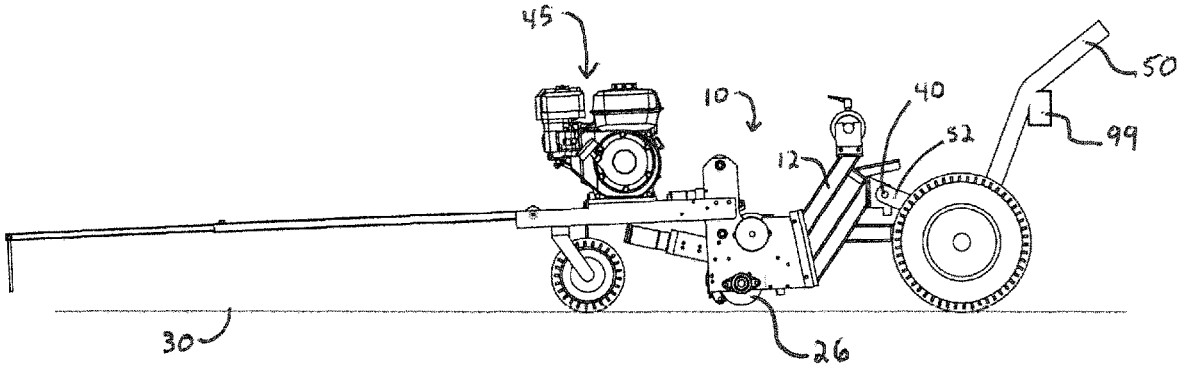
FIG. 6 illustrates the embodiment of FIG. 5 in an elevated configuration.
Figure 7:
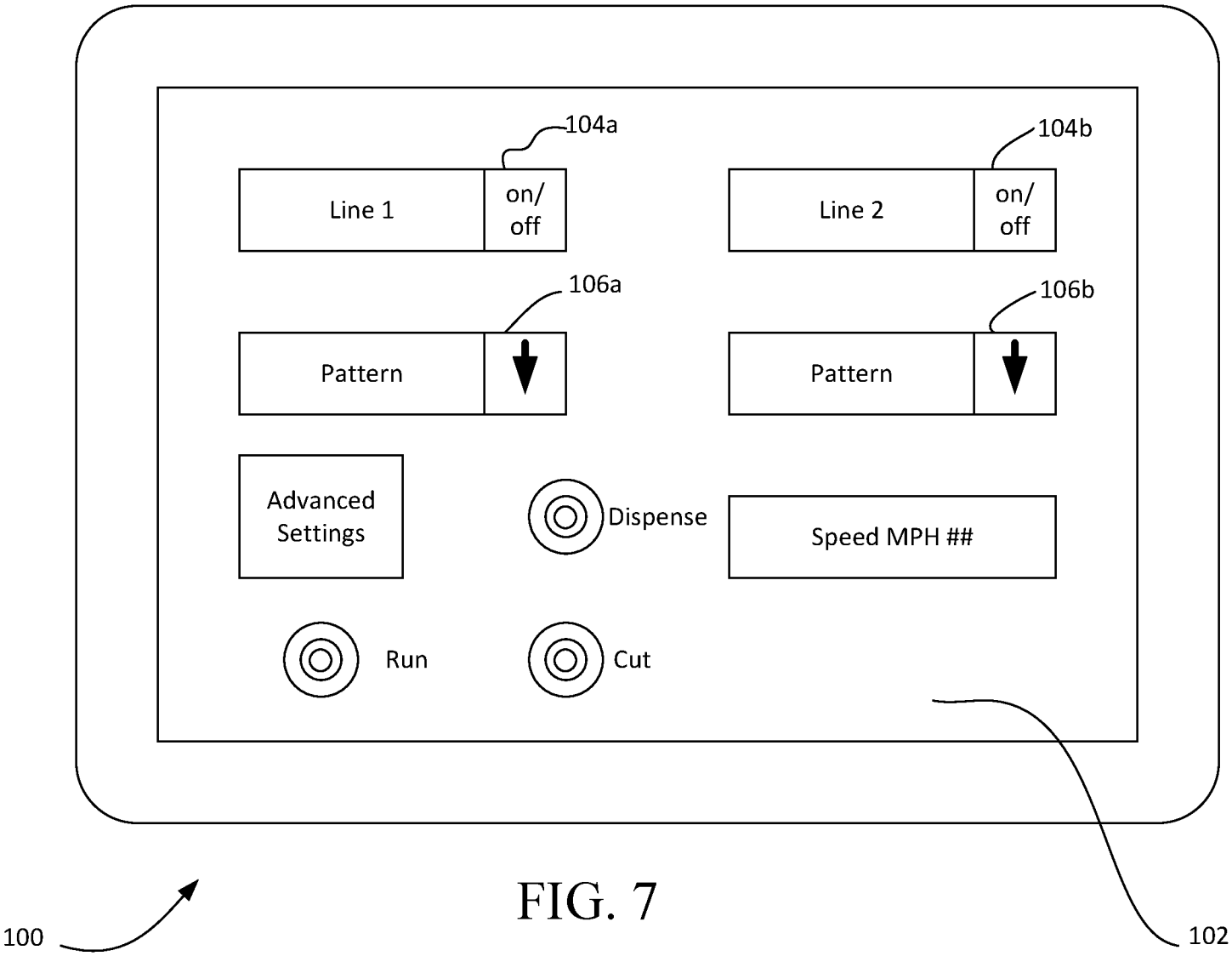
FIG. 7 illustrates an automated controller.

As shown in FIGS. 5 and 6, the frame 12 of ATA 10 may be hingedly affixed to a carrier vehicle, in this case a cart 50. In this regard, an operator may lift the adhesion roller 26 off of the pavement surface 30 and into an elevated configuration when pavement marking tape is not being applied to the pavement surface 30. This may allow for easier transport of the ATA 10 when not in use. FIG. 6 illustrates ATA 10 in the elevated configuration in which the adhesion roller 26 is lifted from the pavement surface. An operator may engage a locking feature to retain the ATA 10 in this position. FIG. 5 illustrates ATA 10 in the application configuration in which the adhesion roller 26 is resting upon the pavement surface 30. Frame 12 is shown being pivotally attached to frame 52 at hinge 40. In this configuration, the locking feature may be disengaged. When pavement marking tape application is desired, the hinged frame 12 allows for lowering the adhesion roller 26 onto the ground. In this application configuration, a majority of the weight of the ATA 10 may be supported on the adhesion roller 26 giving the operator uniform pressure on the pavement marking tape being applied. This improves the application of the pavement marking tape by having sufficient and evenly distributed pressure on the pavement marking tape. Cart 50 includes a frame 52 that supports first and second rear tires. In addition, the cart 50 includes handlebars and controls (e.g., brake handles) which improve the ease with which an operator is able to manipulate the ATA 10. The frame 12 of the ATA 10 is pivotally connected at a hinge 40 to the frame 52 of the cart 50.

In order to maintain the adhesion roller 26 off/above the pavement surface, a mechanism may be provided to secure the ATA 10 in the elevated configuration shown in FIG. 6. As one example, a lock bar (not shown) may be provided to secure frame 12 to frame 52 in the elevated configuration. The lock bar may be pivotally attached to either frame 12 or frame 52 and a corresponding engagement feature (e.g., a lip) may be disposed upon the other. The lock bar may be constructed from the same material as frame 52 (e.g., steel, aluminum, etc.) and may include a notch along its length. The lip may protrude such that the lip may be disposed at least partially within the notch to retain the frame 12 in the elevated configuration. In one embodiment, the lip may be formed from a rod fixed laterally to the frame 12 or 52 but it should be appreciated that the lip may be formed in any appropriate manner, for example, it may be integrally formed with the respective frame.

As an example, the lock bar may be pivotally connected on a first end to the ATA frame 12 and may have a second end that may be manipulated manually by an operator or by an actuation device. For example, a cable actuator may be attached to the second end and a controller for the cable actuator may be disposed near the handlebars. In some embodiments, the automated controller may be used to selectively actuate the cable actuator. It is envisaged that alternative locking mechanisms and actuators may be utilized to effectuate pivoting and locking of the frame 12 with respect to the frame 52 or another carrier vehicle.

Compressor (not shown) may be driven by a gasoline engine 45 or any suitable equivalent. The compressor may supply compressed air to a network of pneumatic tubes to power the various actuators (e.g., actuators 25 and 34). Valves disposed throughout the network of pneumatic tubes may be controlled by the automated controller as needed.

FIG. 6 also illustrates an example placement of automated controller 100 that, among other things, controls the actuation of the knife (or knives) 90, clutch 80, and upper feed mechanism 18, all based off distance traveled as detected by the sensor 82. The automated controller 100 takes that information and processes it in relation to the desired pattern that is loaded in memory or entered via an operator interface to calculate the appropriate timing of actuation of the various components.

Automated controller 100 may be preloaded with a plurality of patterns (e.g., solid line, skip lines with various dimensions, etc.) which an operator can select from the operator interface. The automated controller 100 may actuate the various components at specified distances based on the pattern(s) selected. This allows the automated controller 100 to automatically create skip lines with gaps, apply specified lengths of pavement marking tape 20, etc. In this regard, an operator does not have to initiate cutting or measure manually, although such operation may be optionally provided.

The automated controller 100 typically includes a memory (e.g., non-transient, computer-readable memory) and a processor (e.g., implemented as one or more physical processors, microprocessors etc.). The memory has instructions stored thereon, which, when executed, cause the processor to perform various functions. A user can, in an embodiment, interact with the ATA system through a graphical user interface (GUI) 102 and/or through any other user controls (e.g., buttons, switches, keypads, etc.; not shown). In the illustrated embodiment, a GUI 102 is displayed on the automated controller 100 and includes one or more touchscreen controls. In an embodiment, the automated controller includes touchscreen controls 104*a*, 104*b* to activate or deactivate each tape line. Additional touchscreen controls provide drop-down menus 106*a*, 106*b* for use in selecting a pattern for an activated tape line. The automated controller may additionally include controls to initiate the operation of the ATA, initiate dispensing of tape lines and/or manually cut tape lines. Additional information may be output to or set by the use (e.g., speed; mph).

Incorporation of the features described above may permit the ATA 10 to provide enhanced functionality. For example, the incorporation of the automated controller 100 and split or dual knives 90 may allow for application of one or two pavement marking lines in a single pass. An operator may be able to load a first pattern and a second pattern to apply different types of markings, for example, a solid line and a skip line simultaneously. With multiple knives 90, an operator may be able to cut a minimum of two different patterns on the same pass. In some embodiments, additional components may also be split such as the upper guide roller 22, the upper feed mechanism 18, or the supply spindle 14. That is, such components may be operative to rotate independent of one another. In such an arrangement, each of the axially aligned upper guide rollers may incorporate its own clutch.

It is also envisaged that a pointer bar may extend from the front end of ATA 10 for guiding an operator, or a laser may be mounted on the ATA 10 and directed at the pavement surface. One or more sensors may be configured to monitor such a pointer bar or laser and send feedback signals to the automated controller 100. In this regard, the automated controller 100 may adjust certain distances or timing to compensate for positioning indicated by the feedback signals.

The foregoing description of the presented inventions has been presented for purposes of illustration and description. Furthermore, the description is not intended to limit the inventions to the forms disclosed herein. Consequently, variations and modifications commensurate with the above teachings, and skill and knowledge of the relevant art, are within the scope of the presented inventions. The embodiments described hereinabove are further intended to explain best modes known of practicing the inventions and to enable others skilled in the art to utilize the inventions in such, or other embodiments and with various modifications required by the particular application(s) or use(s) of the presented inventions. It is intended that the appended claims be construed to include alternative embodiments to the extent permitted by the prior art.

What is claimed is:

1. A pavement making apparatus for installing pavement marking tape on a pavement surface, comprising:

a front frame having a front wheel disposed at a forward end of the front frame and a hinge at a rearward end of the front frame;

a rear frame having first and second wheels, the rear frame being hingedly connected to the front frame by the hinge, wherein the front frame and the rear frame pivot relative to one another about the hinge between a lifted position and a lowered position; and a tape applicator attached to the front frame between the front wheel at the forward end of the front frame and the hinge at the rearward end of the front frame, the tape applicator having an adhesion roller for applying pressure to a non-adhesive side of pavement marking tape to a pavement surface, wherein the adhesion roller is suspended above the pavement surface when the front frame and rear frame are in the lifted position and the adhesion roller contacts the pavement surface when the front frame and rear frame are in the lowered position.

2. The apparatus of claim 1, wherein the front wheel is a swiveling front wheel, and wherein the swiveling front wheel is selectively lockable to restrict swiveling.

3. The apparatus of claim 1, further comprising:

a sensor disposed adjacent to a moving component of the tape applicator, wherein a rate of rotation of the moving component is directly associable with a speed of the tape applicator relative to said pavement surface and wherein the sensor transmits a signal regarding the rate of rotation to the controller.

4. The apparatus of claim 3, wherein the moving component is a toothed sprocket that is rotated as a result of the adhesion roller rolling across said pavement surface.

5. The apparatus of claim 1, wherein the tape applicator further comprises:

a first a supply spindle onto which one or more rolls of pavement marking tape may be installed;

an upper guide roller for directing pavement marking tape from the one or more rolls toward the adhesion roller; and a cutting mechanism disposed between the upper guide roller and the adhesion roller for cutting the pavement marking tape.

6. The apparatus of claim 5, wherein the cutting mechanism comprises a first knife and a second knife, wherein the first knife is configured to cut pavement marking tape from a first roll of pavement marking tape and the second knife is configured to cut pavement marking tape from a second roll of pavement marking tape.

7. The apparatus of claim 6, further comprising:

a first knife actuator operably engaged with the first knife;

a second knife actuator operably engaged with the second knife; and a controller in operative communication with the first and second knife actuators and configured to control each of the first and second knife actuators independently.

8. The apparatus of claim 7, wherein the controller is programmable with at least a first pattern and a second pattern for application of pavement marking tape, wherein an operator may select the first pattern for application of pavement marking tape from the first roll of pavement marking tape and the second pattern for application of pavement marking tape from the second roll of pavement marking tape.

9. The apparatus of claim 7, wherein the controller calculates a distance traveled by the automated tape applicator as a function of the signal from the sensor and transmits control signals to direct operation of:

the first knife actuator; and the second knife actuator.

10. The apparatus of claim 9, further comprising:

a drive mechanism operatively attaching the adhesion roller to the upper guide roller to rotate the upper guide roller in response to rotation of the adhesion roller across the pavement surface.

11. The apparatus of claim 9, further comprising:

a clutch in operative engagement with the upper guide roller, wherein the clutch is controllable by the automated controller to effect at least one of rotational engagement and disengagement of the upper guide roller with respect to the drive mechanism.

* * * * *